United States Patent [19]

Coyle, Sr.

[11] 4,381,584

[45] May 3, 1983

[54] DUAL STRING SPIDER

[75] Inventor: William E. Coyle, Sr., Houma, La.

[73] Assignee: Bilco Tools, Inc., Houma, La.

[21] Appl. No.: 216,661

[22] Filed: Dec. 15, 1980

[51] Int. Cl.[3] ..... A44B 21/00; E21B 19/07

[52] U.S. Cl. ..... 24/263 D; 24/263 DA; 24/263 CA; 166/75 A; 294/102 A

[58] Field of Search ..... 24/263 R, 263 D, 263 DA, 24/263 CA, 263 DC; 82/45; 294/86.12, 86.1, 102 A, 90; 166/313, 75 A, 85

[56] References Cited

U.S. PATENT DOCUMENTS

| | | | |
|---|---|---|---|
| 1,502,628 | 7/1924 | Hanna | 24/263 D |
| 2,572,318 | 10/1951 | Church | 24/263 DA |
| 2,612,671 | 10/1952 | Martin . | |
| 3,154,146 | 10/1964 | Brown | 166/77.5 |
| 3,330,354 | 7/1967 | Chamblee . | |
| 4,354,706 | 10/1982 | Coyle, Sr. | 294/102 A |

*Primary Examiner*—Robert A. Hafer
*Assistant Examiner*—John G. Weiss
*Attorney, Agent, or Firm*—Vinson & Elkins

[57] ABSTRACT

A dual string spider having a body of two halves pivotally secured at one side and releasably secured at the other side with bowls extending through the body and open to each other, gripping means for each bowl, an actuator for each gripping means, and bars extend through the body halves to divide the bowls and to center well strings in their respective bowls.

3 Claims, 4 Drawing Figures

36
38
52
54
40
42
50
44
42
46
18
24
30
32
22
30
34
18
18
30
20
28
26
10
12c
14
48
12b
48
12a
12e
12d
58
56
60
66
12

FIG. 2
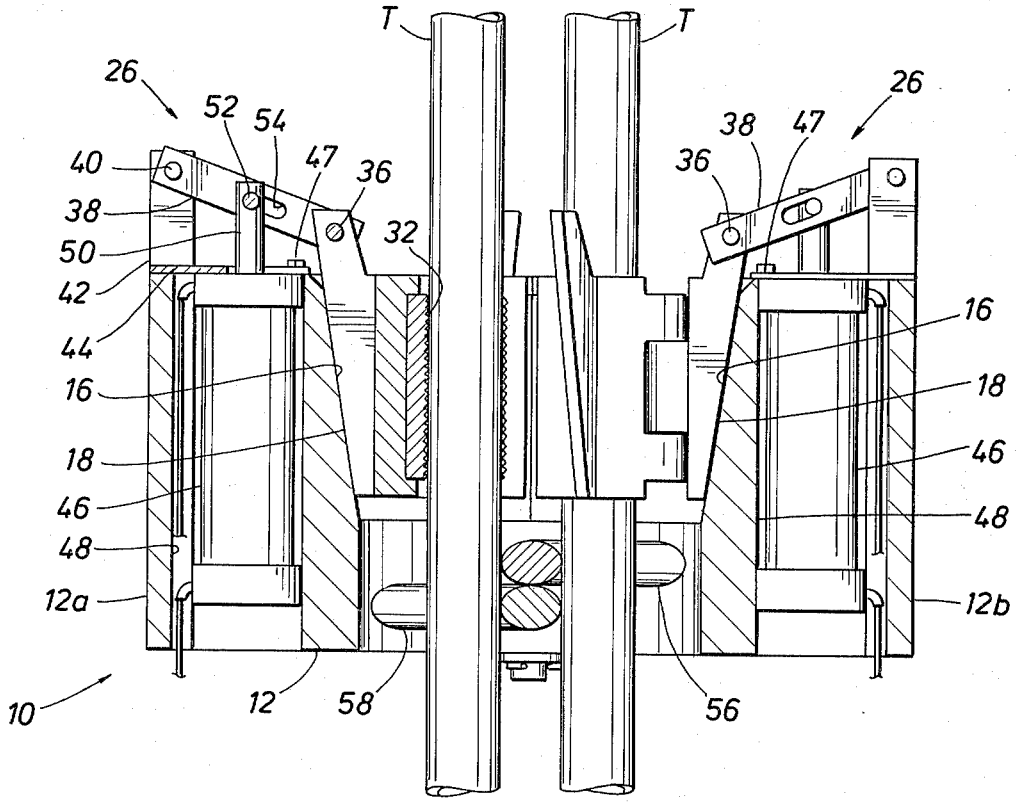
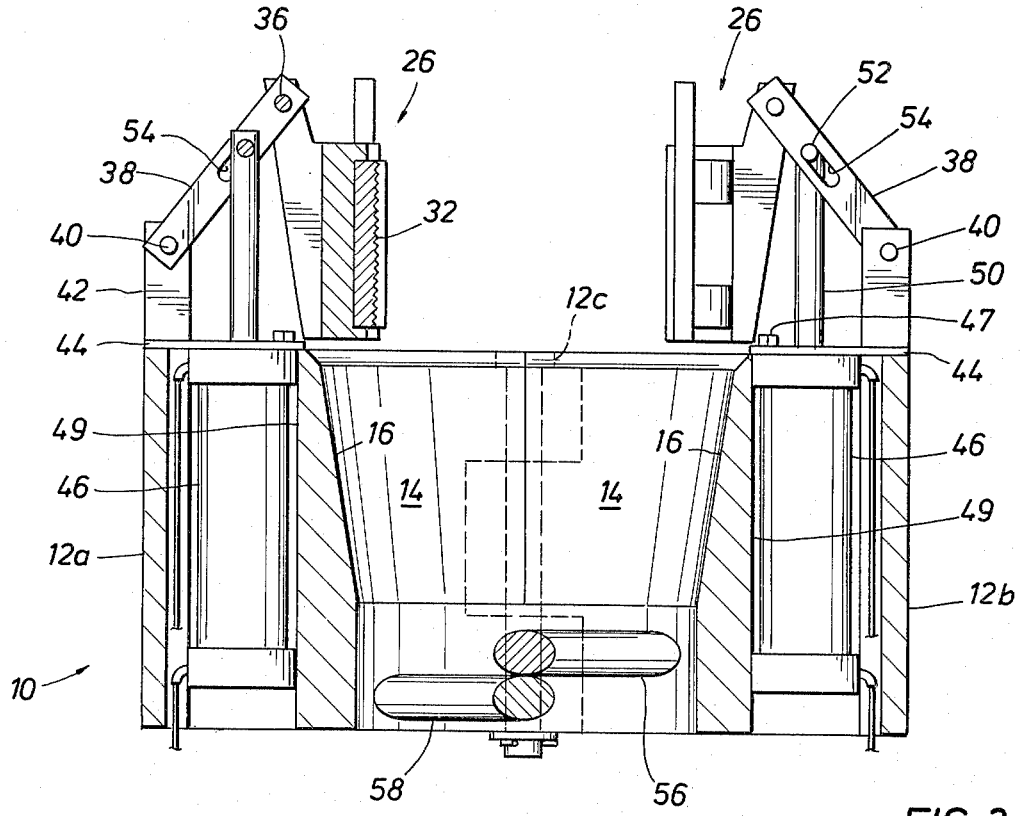
FIG. 3

DUAL STRING SPIDER

BACKGROUND

Equipment for running and retrieving pipe strings has long included spiders. Spiders have included a body defining one or more bowls into which gripping means is positioned to engage and support a pipe string or tubing string. Spiders have been used which support one, two or multiple strings.

The C. C. Brown U.S. Pat. No. 3,154,146 illustrates a prior spider having a plurality of bowls and gripping slips for each bowl linked together for actuation. The bowls are completely separated and are not partially open to each other to accommodate two or more strings in a minimum bore.

The J. R. Martin U.S. Pat. No. 2,612,671 discloses a spider for supporting a single pipe or tubing string.

The E. C. Chamblee U.S. Pat. No. 3,330,354 discloses a pipe hanger assembly including a hinged base and segmented inserts defining bowls in which slips are positioned to support well strings.

Reference is also made to my prior copending application Ser. No. 06/155,477, filed June 2, 1980, entitled "Dual String Elevators" which discloses similar gripping means and actuator structure for an elevator.

SUMMARY

The present invention relates to an improved spider for supporting pipe and tubing strings in a well bore. The improved spider includes a two-piece body pivotally mounted at one end of each body section and releasably secured at the other end of each body section with partial bowls extending through the body, gripping members with actuators for each bowl and means extending through the body between the lower portion of the bowls to separate tubing extending through each bowl.

An object of the present invention is to provide an improved spider in which tubing strings extending therethrough are retained in their respective bowls.

A further object is to provide an improved well string spider for two strings which occupies a minimum of area by allowing close side-by-side positioning of the strings.

Another object is to provide an improved well string spider with overlapping bowls in which the strings are guided and separated therein without interferring with the operation of the slips.

BRIEF DESCRIPTION OF THE DRAWINGS

These and other objects and advantages of the present invention are hereinafter set forth and explained with respect to the drawings wherein:

FIG. 2 is a sectional view taken through the axes of both bowls and showing gripping means in position supporting well strings extending through the bowls.

FIG. 3 is a view similar to FIG. 2 illustrating the raising of the gripping means above their bowls.

DESCRIPTION OF THE PREFERRED EMBODIMENT

Figure 1:
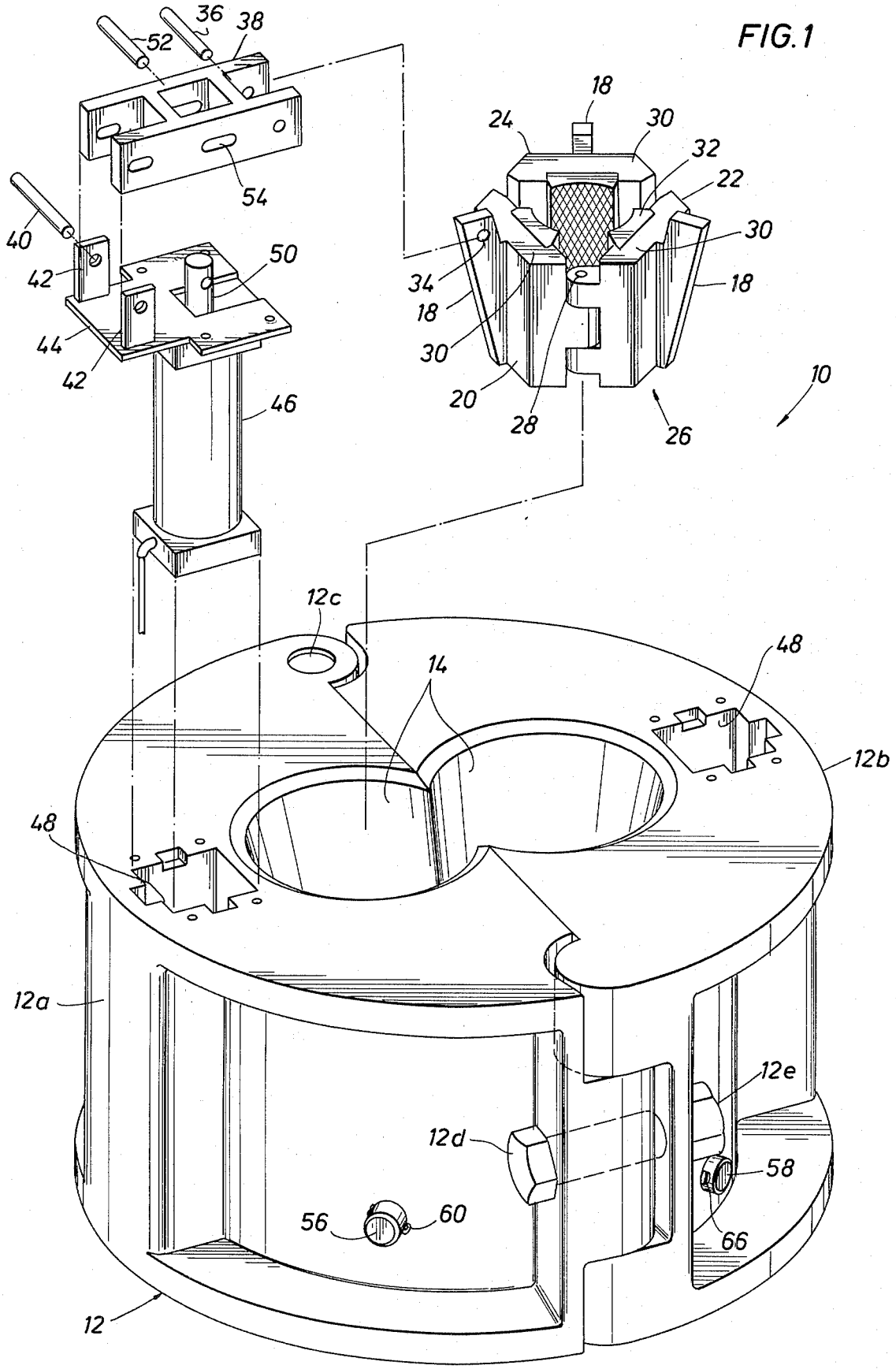
FIG. 1 is an isometric exploded view of the improved dual string spider of the present invention with one of the gripping means and its actuator being omitted for purpose of clarity.

Spider 10 shown in the drawings is the preferred form of a dual string spider of the present invention. Spider 10 includes body 12 having two halves 12*a* and 12*b* which are pivotally connected at one side by pin 12*c* and secured at the opposite side by bolt 12*d* and nut 12*e*. Body 12 has bowls 14 extending vertically therethrough with tapered walls 16 which coact with tapered wedges 18 on the exterior of each slip 20, 22 and 24 of each gripping means 26. Gripping means 26 include main slip 20 and side slips 22 and 24 pivotally connected by pins 28 to main slip 20. Suitable means, such as cotter pins (not shown) are provided to retain pins 28 in engagement between slip 20 and slips 22 and 24. Each slip includes back 30 with wedge 18 secured to the exterior thereof by welding or other suitable means and gripping elements 32 secured on the inner surface of back 30 as shown.

The upper end of each wedge 18 on main slips 20 has hole 34 therethrough to receive pin 36 which connects the end of link 38 to gripping slip 26. The opposite end of link 38 is connected by pin 40 to brackets 42 extending upward from plate 44. Plate 44 is secured to the upper end of actuator 46 and is secured by cap screws 47 to body 12 with actuator 46 positioned in recess 48 in body 12. Rod 50 extends from actuator 46 and is connected by pin 52 to central slots 54 in link 38. Pins 36, 40 and 52 include means to retain them in engagement with link 38 and gripping slips 26, brackets 42 and rod 50, respectively, such as cotter pins or snap rings (not shown).

Figure 4:
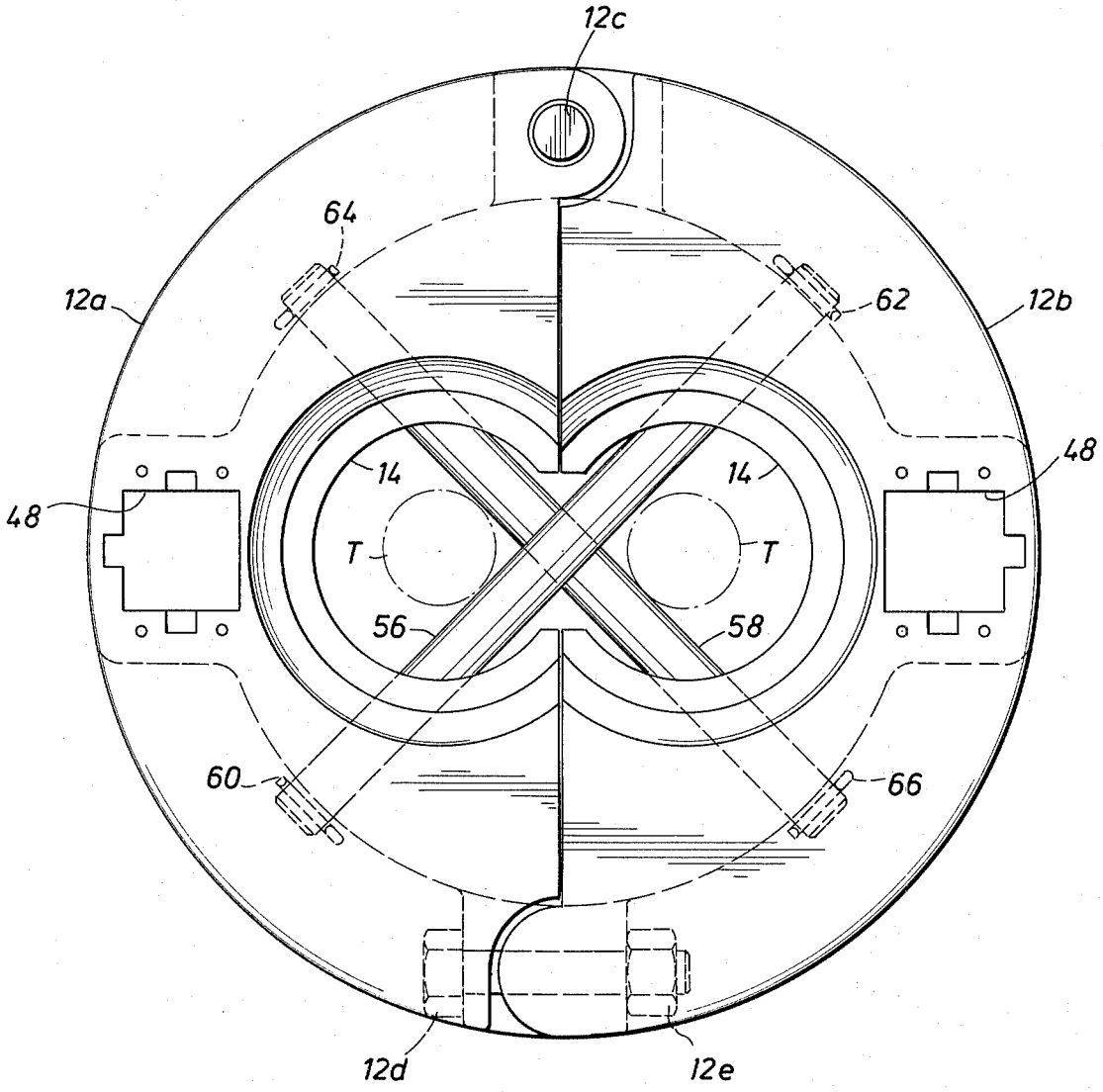
FIG. 4 is a plan view of the improved spider with the gripping means and their actuators removed for clarity to illustrate the centering of the well strings provided by the transverse bars.

Bars 56 and 58 extend through body 12 as best shown in FIG. 4. Bar 56 extends through the wall of body half 12*a*, with cotter pin 60 extending through bar 56 to prevent its inward movement, across between bowls 14, and through the wall of body half 12*b* with cotter pin 62 extending through bar 56 to prevent its inward movement. Thus bar 56 is releasably secured in position by pins 60 and 62 or any other suitable means. Bar 58 extends through body halves 12*a* and 12*b* as shown and is positioned below bar 56 and is also generally perpendicular to bar 56 so that bars 56 and 58 provide a lower partition between bowls 14 to separate the strings T extending therethrough. Bar 58 is releasably secured in position by cotter pins 64 and 66 on the exterior of body halves 12*a* and 12*b* as shown in FIG. 4. Bars 56 and 58 are releasably positioned in body 12 so that if desired, bolt 12*d* and nut 12*e* can be removed and after removal of bars 56 and 58, body 12 can be pivoted open and removed from strings T.

Tubing strings T are supported by gripping means 26 in bowls 14 as shown in FIG. 2. In such position, piston rods 50 are retracted and gripping slips 26 are seated in bowls 14 with gripping elements 32 in tight supporting engagement with strings T. Also, bars 56 and 58 extending across between bowls 14 both guide strings T as they are run therethrough and retained them within their respective bowls to assure that gripping means 26 properly engage strings T. To release this engagement, pressure is supplied to actuators 46 to extend rods 50 as strings T are lifted. The extension of rods 50 moves link 38 and gripping slips 26 upwardly and outwardly to the position shown in FIG. 3. In this position, gripping means 26 are moved out of bowls 14 and spider 10 is free of any connection to the tubing strings T.

Whenever spider 10 is to support strings T, actuators 46 are provided with fluid pressure or air to retract rod 50 to move gripping slips 26 to the position shown in FIG. 2. Thereafter, because of the taper of walls 16 of walls 14, the weight of strings T moves gripping slips down in bowls 14 which tightens their supporting engagement on strings T.

What is claimed is:

1. A dual spider comprising a body having a pair of tapered bowls extending therethrough with said bowls being open to each other at their inner portions a set of gripping slips for each bowl, an actuator for each set of gripping slips a pair of bars extending across the lower portion of said body below said bowls, said bars in plan view being substantially perpendicular to each other and intersecting mid way between the centers of said bowls to provide a barrier therebetween, and means releasably securing the ends of the bars in said body.

2. A dual string spider according to claim 1 wherein said body is formed in two halves with one of said bowls in each half, and including means pivotally connecting one end of each of said halves, and means releasably securing the other end of said halves together.

3. A dual spider according to claim 1 including a pair of recesses in said body said slip actuators being positioned in said recesses.

* * * * *